US007686188B2

(12) United States Patent
Stebick et al.

(10) Patent No.: US 7,686,188 B2
(45) **Date of Patent: *Mar. 30, 2010**

(54) DRAIN-BACK SPOUT FITMENT CLOSURE WITH DRIP-LESS POUR TIP

(75) Inventors: Matthew E. Stebick, Waterford, PA (US); Robert J Smith, Edinboro, PA (US); Brian P Masterson, Erie, PA (US); Bruce D Allen, Spartansburg, PA (US)

(73) Assignee: Berry Plastics Corporation, Evansville, IN (US)

( * ) Notice: Subject to any disclaimer, the term of this patent is extended or adjusted under 35 U.S.C. 154(b) by 704 days.

This patent is subject to a terminal disclaimer.

(21) Appl. No.: 11/018,417

(22) Filed: Dec. 21, 2004

(65) Prior Publication Data

US 2006/0131330 A1 Jun. 22, 2006

(51) Int. Cl.
*B67D 1/16* (2006.01)
*B65D 5/72* (2006.01)

(52) U.S. Cl. ..... 222/109; 222/571; 222/111; 222/568

(58) Field of Classification Search ..... 222/109, 222/571, 153.06, 153.07, 153.1, 111, 570, 222/108, 110, 475.1, 568, 567, 566; 215/252, 215/253, 258; 99/323.3, 307, 306
See application file for complete search history.

(56) References Cited

U.S. PATENT DOCUMENTS 1,658,395 A * 2/1928 Rawlings ..... 222/570
2,601,040 A 3/1956 Livingstone
2,743,844 A 4/1956 Livingstone
2,763,402 A 9/1956 Livingstone
2,763,403 A * 9/1956 Livingstone ..... 222/111
2,793,790 A * 5/1957 Kahler ..... 222/109
2,808,964 A 10/1957 Radtke
3,369,710 A 2/1968 Lucas
3,521,745 A 7/1968 Schwartzman
3,603,469 A 9/1971 Magni
3,715,189 A 2/1973 Nighohossian et al.
3,833,150 A * 9/1974 Visser-Patings ..... 222/109
3,968,872 A 7/1976 Cavazza
4,078,700 A 3/1978 Hidding
4,128,189 A 12/1978 Baxter
4,195,731 A 4/1980 Cavazza
4,221,291 A 9/1980 Hunt
4,308,969 A * 1/1982 Heisler et al. ..... 220/266
4,550,862 A * 11/1985 Barker et al. ..... 222/109
4,615,437 A 10/1986 Finke et al.

(Continued)

*Primary Examiner*—Kevin P Shaver
*Assistant Examiner*—Stephanie E Tyler
(74) *Attorney, Agent, or Firm*—Barnes & Thornburn LLP

(57) ABSTRACT

A snap on, drain back fitment closure for a container, wherein the drain back pour spout fitment has a snap fit structure overlaying a container or bottle neck finish and which may be secured thereto with adhesives. The snap fit structure has an outer annular skirt with an internal, radial inwardly facing bead engaging a radial outwardly facing surface of the bottle finish. Spaced from the outer annular skirt by a horizontal upper flange, the spout fitment includes an inner annular skirt with internal threads on the fitment to receive an externally threaded closure. The closure has a plug seal above the threads engaging the fitment. Further the pour spout has a radial outwardly extending drip-less pour spout at an end thereof.

20 Claims, 3 Drawing Sheets

U.S. PATENT DOCUMENTS 4,671,421 A 6/1987 Reiber et al.
4,696,416 A 9/1987 Muckenfuhs et al.
4,706,829 A 11/1987 Li
4,773,560 A 9/1988 Kittscher
4,830,234 A 5/1989 Odet
4,836,419 A 6/1989 Metz et al.
4,844,302 A * 7/1989 Lay ..... 222/568
4,858,760 A 8/1989 Di Sturco
4,863,067 A 9/1989 Krall
4,890,770 A 1/1990 Haga et al.
4,903,865 A 2/1990 Janowitz
4,917,268 A 4/1990 Campbell et al.
4,917,269 A * 4/1990 Fuchs et al. ..... 222/109
4,917,270 A 4/1990 Simon
4,974,749 A 12/1990 Mon
4,981,239 A 1/1991 Cappel et al.
4,984,714 A 1/1991 Sledge
4,993,605 A 2/1991 Del'Re
5,029,718 A 7/1991 Rizzardi
5,038,951 A 8/1991 Rizzardi
5,058,772 A 10/1991 Moore et al.
5,108,009 A 4/1992 Davidson et al.
5,114,659 A 5/1992 Krall
5,131,566 A 7/1992 Bavegems
5,207,356 A * 5/1993 Krall ..... 222/109
5,234,130 A 8/1993 Benioff et al.
5,251,788 A 10/1993 Moore
5,431,306 A 7/1995 Reid
5,462,202 A 10/1995 Haffner et al.
5,566,862 A 10/1996 Haffner et al.
5,597,090 A 1/1997 Leahy
5,603,787 A * 2/1997 Reid ..... 156/73.1
5,772,017 A 6/1998 Kang
5,794,803 A 8/1998 Sprick
5,850,953 A * 12/1998 Dallas, Jr. ..... 222/571
5,855,299 A 1/1999 Arnold et al.
5,941,422 A 8/1999 Struble
5,950,819 A 9/1999 Sellars
6,032,829 A 3/2000 Geisinger et al.
6,123,231 A 9/2000 Geisinger
6,165,523 A 12/2000 Story
6,209,762 B1 4/2001 Haffner et al.
6,223,945 B1 5/2001 Giblin et al.
6,223,946 B1 5/2001 Geisinger et al.
6,224,922 B1 5/2001 Fonte
6,279,789 B1 8/2001 Krall
6,305,576 B1 10/2001 Leoncavallo
6,372,270 B1 4/2002 Denny
6,375,041 B1 * 4/2002 Klima et al. ..... 222/129
6,398,076 B1 * 6/2002 Giblin et al. ..... 222/109
6,431,401 B1 8/2002 Giblin et al.
6,464,106 B1 10/2002 Giblin et al.
6,923,341 B2 8/2005 Smith
2002/0011498 A1 * 1/2002 Giblin et al. ..... 222/109
2004/0026450 A1 2/2004 Rohr

* cited by examiner

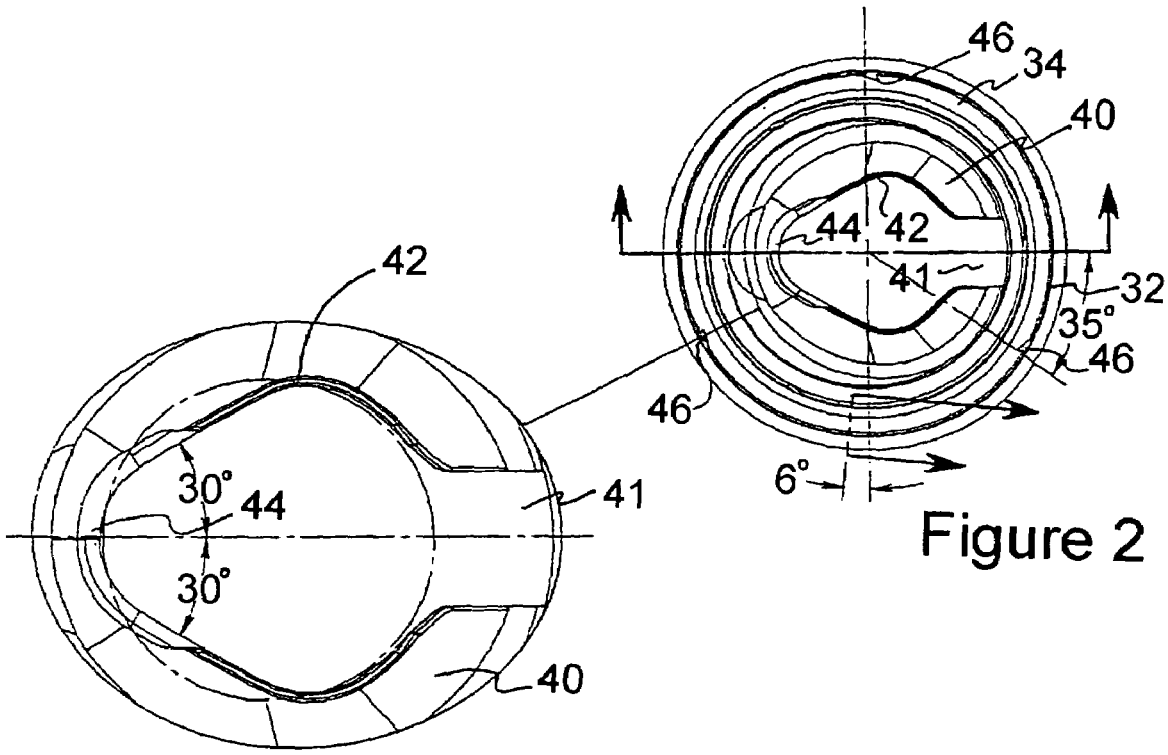
Figure 2
Figure 3
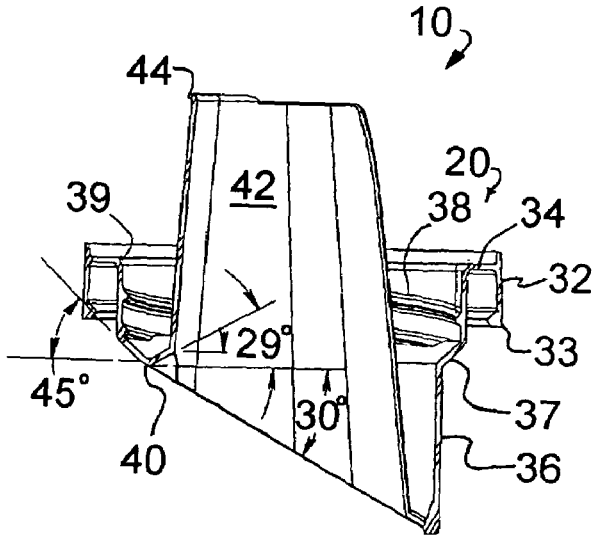
Figure 1

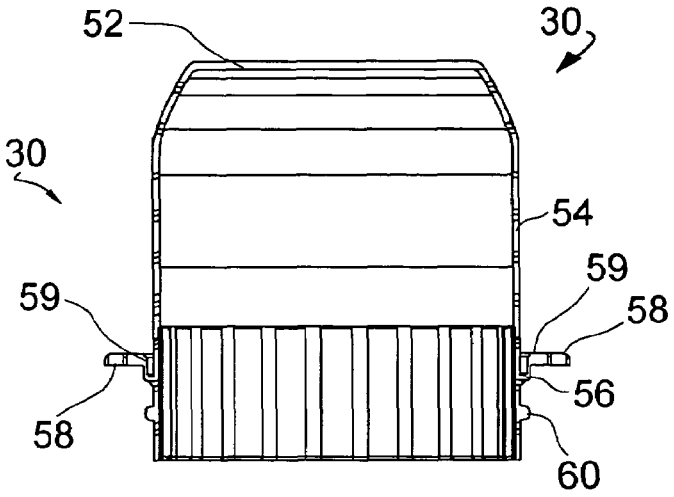
Figure 7
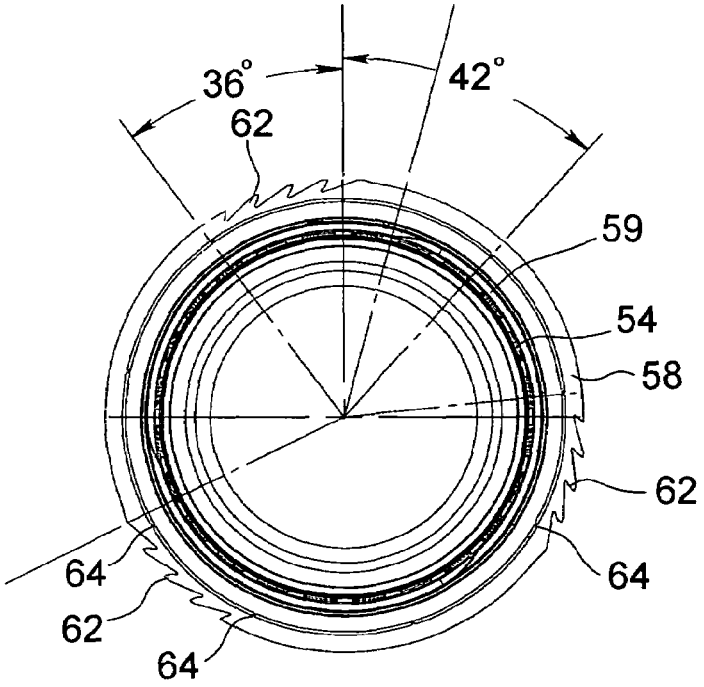
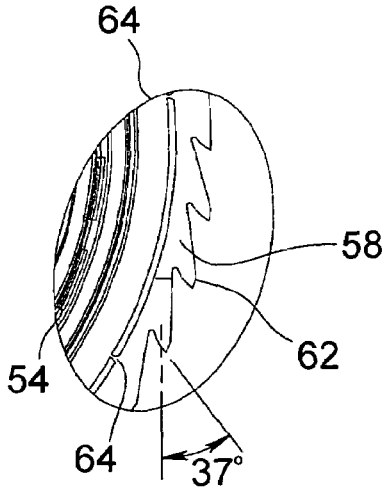
Figure 9
Figure 8

DRAIN-BACK SPOUT FITMENT CLOSURE WITH DRIP-LESS POUR TIP

BACKGROUND OF THE INVENTION

1. Field of the Invention

The present invention relates to drain-back pour spout closures for containers and more specifically to drain-back, snap-on pour spout fitment closures for containers with drip-less pour tip and tamper evident features.

2. Background of the Invention

Drain-back pour spouts are very well known in the art. One class of drain back pour spouts forms the spout as a fitment attached to a separate container with a separate closure for the fitment. One subset of this class is those devices having the closure, or cap, attached to the bottle and another subset is having the cap attached to the fitment or pour spout. A second class of drain-back pour spouts is one in which the spout is formed integral with the container, in other words the spout forms a specialized finish (e.g. neck finish) for the container. In this class the closure is always connected directly to the container since there is no separate fitment. A review of the representative prior art will further clarify the state of the art.

U.S. Pat. Nos. 6,464,106 and 6,431,401, both assigned to Lever Brothers Company, disclose a drain back converging nozzle spout fitment secured to a container opening with an external ridge engaging an internal ring on the container. A closure or cap is threaded onto the container over the fitment to close the container opening.

U.S. Pat. No. 6,398,076, assigned to Unilever Home& Personal Care USA, discloses a variety of drain back, snap on, cylindrical nozzle, pour spout fitments with inside of the spout (also called the gutter or apron) not extending below outer connecting flange of the fitment.

U.S. Pat. No. 6,375,041 discloses a container with an integral (or separate) drain back, converging nozzle neck finish (or fitment if it is separate) with a cap or closure threaded onto the spout portion, wherein the cap includes a reservoir for holding a concentrated product, e.g. detergent. If separate the fitment would be apparently press fit or welded to the container opening.

U.S. Pat. No. 6,279,789, assigned to Owens-Brockway Plastics Products, Inc., discloses a variety of spout (both integral with the container and as separate fitments) and closure configurations with the cap or closure including a disk with a metallic under-layer for induction welding to associated structure. One embodiment shown in FIG. 3 includes a fitment secured within the container finish with the cap threaded to the fitment with internal threads on the fitment.

U.S. Pat. No. 6,223,946, assigned to Owens-Illinois Closures, Inc., discloses a bottle with integral drain back spout and closure configuration with threads formed on the neck of the bottle engaging the closure directly.

U.S. Pat. No. 6,223,945, assigned Lever Brothers Company, discloses a specific three layer bottle composition for the fitment and closure of U.S. Pat. No. 6,464,106 discussed above.

U.S. Pat. No. 6,209,762, assigned to Owens-Illinois Closures, Inc., discloses a bottle with snap in drain back spout configuration having a projecting lug and receiving slot for positioning of the fitment.

U.S. Pat. No. 6,123,231, assigned to Owens-Brockway Plastics Products, Inc., discloses a one piece bottle with integral drain back spout configuration.

U.S. Pat. No. 6,032,829, assigned to Owens-Illinois Closures, Inc., discloses a bottle with integral spout and closure configuration with threads formed on the neck of the bottle engaging the closure directly.

U.S. Pat. No. 5,941,422, assigned to Owens-Brockway Plastics Products, Inc. discloses a bottle, drain back spout fitment and closure configuration with a unique bottle neck finish having a radial inwardly annular wall and an axial wall extending upwardly and away from the inner extending wall. The fitment has a depending apron extending over the neck finish and welded thereto.

U.S. Pat. No. 5,855,299, assigned to Graham Packaging Corporation, discloses a drain back spout fitment configuration with an inner radial outwardly facing annular bead engaging a shoulder of the bottle neck.

U.S. Pat. No. 5,794,803, assigned to Rexam Closures, Inc., discloses a drain back spout fitment configuration with a cap threaded onto threads of the bottle and with a child safety lock mechanism between the bottle and the cap, wherein the latch release on the cap is biased in a radial direction away from the bottle.

U.S. Pat. No. 5,603,787, assigned to Innovative Molding Inc., discloses a method of assembly of a bottle with a pour back spout configuration with an annular solid wall and the pour back feature being formed in an opening in the outer wall or trough. The method includes ultrasonic welding of the pour spout fitment to the container.

U.S. Pat. No. 5,597,090 discloses a spout fitment configuration with a "v" shaped notch at the terminal end. The cap is threaded to the bottle over the spout fitment.

U.S. Pat. Nos. 5,566,862 and 5,462,202, both assigned to Owens-Illinois Plastics Products, Inc. disclose a drain back spout fitment configurations with an annular solid wall and the pour back feature being formed in an extended opening in the outer wall. The closure is threaded onto the bottle over the fitment.

U.S. Pat. No. 5,431,306, assigned to Innovative Molding Inc., discloses a drain back spout fitment configuration with an annular top flange bonded to an upper end of the bottle neck finish. The closure is threaded to the fitment with external threads on the closure engaging internal threads on the fitment below a sealing portion there-between.

U.S. Pat. No. 5,251,788, assigned to Phoenix Closures, Inc., discloses a bottle, drain back frusto-conical or converging nozzle spout fitment and cap configuration. The bottle includes a threaded neck to receive the threaded spout. The cap is threaded to an upper portion of the annular wall.

U.S. Pat. No. 5,234,130, assigned to Manhattan Products, discloses a bottle, drain back pour spout fitment and cap configuration. The bottle includes an internal neck finish recess to engage a retaining member on the spout and allow the cap to seal against the bottle finish.

U.S. Pat. No. 5,207,356, assigned to Owens-Illinois Plastics Products, Inc., discloses a bottle with an integral spout and cap configuration.

U.S. Pat. No. 5,131,566, assigned to Proctor & Gamble Company, discloses a package assembly with a "refill facilitating" drain back spout having piecing serrations on the spout. An associated closure is not disclosed.

U.S. Pat. No. 5,114,659, assigned to Owens-Illinois Plastic Products Inc., discloses a method of making a one piece bottle and integral drain back pour spout.

U.S. Pat. No. 5,108,009, assigned to Lever Brothers Company, discloses a bottle, drain back spout fitment and cap configuration with the cap screwed onto the container.

U.S. Pat. No. 5,058,772, assigned to Phoenix Closures, discloses a bottle, drain back pour spout fitment and cap configuration. The spout fitment is threaded to the bottle and includes external threads on an upper portion thereof for the cap to be threaded onto.

U.S. Pat. No. 4,993,605, assigned to Colgate Palmolive Co., discloses a bottle, drain back pour spout fitment and cap configuration wherein the cap engages the container (e.g. threaded bottle neck) to urge the spout fitment into sealing engagement with the neck finish.

U.S. Pat. No. 4,984,714 discloses a bottle, spout fitment and cap configuration with the cap threaded to the bottle.

U.S. Pat. No. 4,981,239, assigned to Proctor & Gamble Company, discloses a bottle with an integral spout and cap configuration.

U.S. Pat. No. 4,974,749, assigned to Colgate Palmolive Co., discloses a bottle, drain back pour spout fitment and cap configuration with a threaded bottle neck finish that the cap threads onto.

U.S. Pat. No. 4,917,270 discloses a bottle, drain back pour spout fitment and cap configuration with a threaded bottle neck finish that the cap threads onto.

U.S. Pat. No. 4,917,269, assigned to Owens-Illinois Plastics Products, Inc., discloses a bottle with an integral spout and cap configuration.

U.S. Pat. No. 4,917,268, assigned to The Clorox Company, discloses a bottle, drain back pour spout fitment and cap configuration with a special interlocking and centering feature between the bottle neck finish and the fitment. The cap is threaded onto the bottle.

U.S. Pat. No. 4,890,770 discloses a unique bottle spout and cap configuration with an inside drainage passage between the cap and the outside of the spout.

U.S. Pat. No. 4,863,067, assigned to Owens-Illinois Plastics Products, Inc. discloses a bottle with an integral spout and cap configuration.

U.S. Pat. No. 4,836,419 discloses a drain back spout fitment and cap configuration with a drain in the apron or floor portion adjacent the spout. The drain back opening has a blocking mechanism to selectively block the opening. The cap is threaded external threads on the fitment on an apron around the bottle opening.

U.S. Pat. No. 4,830,234 discloses a bottle, drain back pour spout fitment and cap configuration with a threaded bottle neck finish that the cap threads onto.

U.S. Pat. No. 4,773,560 discloses a bottle, drain back pour spout fitment and cap configuration with a threaded bottle neck finish that the cap threads onto.

U.S. Pat. No. 4,706,829, assigned to Owens-Illinois Closure, Inc., discloses a bottle, drain back pour spout fitment and cap configuration with a threaded bottle neck finish that the cap threads onto.

U.S. Pat. No. 4,696,416, assigned to Proctor & Gamble, discloses a bottle, a drain back spout fitment threaded to the container, and cap threaded to an upper portion of the fitment, with a drip accumulator structure extending down from the drain hole.

U.S. Pat. No. 4,671,421 discloses a bottle, drain back spout fitment and cap configuration with the spout fitment engaging the inner surface of the container interconnecting the spout fitment with the bottle.

U.S. Pat. Nos. 4,550,862, 4,128,189, 4,078,700, 3,369,710, 2,808,964, 2,763,403, 2,763,402, 2,743,844, and 2,601,040 also show a variety of drain back spout configurations similar to those discussed above.

There remains a need in the art to provide a drain-back snap-on pour spout fitment closure for containers which is economical to mold and provides the desired performance features in the resulting closure. It is the object of the present invention to improve upon the prior art designs and to address this need.

SUMMARY OF THE INVENTION

The objects of the present invention are achieved with a drain-back snap-on pour spout fitment closures for containers according to the present invention. The proposed design includes a drain back pour spout fitment with a snap fit structure overlaying a container or bottle neck finish and which may be secured thereto with adhesives or by welding. The snap fit structure has an outer annular skirt with at least one internal, radial inwardly facing bead generally engaging beneath a radial outwardly facing surface of the bottle finish. Spaced from the outer annular skirt by a horizontal upper flange, the spout fitment includes an inner annular skirt with internal threads on the fitment to receive an externally threaded closure. The closure has a plug seal above the threads engaging the associated structure of the fitment generally near the upper flange of the fitment. Further the closure has, prior to the first use by a consumer, a radial outwardly facing tamper evident band engaging a radial inwardly facing interfering projections on the fitment forming a tamper evidence safety feature for the closure. The pour spout of the present invention further includes an outwardly extending drip-less pour tip at an end thereof, wherein the pour tip has a curved (adjacent dual radiuses) upper surface extending beyond the upwardly extending side surfaces of the pour spout, and wherein the pour tip is opposite from the drain back elements of the pour spout.

These and other advantages of the present invention will be clarified in the detailed description of the preferred embodiment taken together with the attached drawings.

BRIEF DESCRIPTION OF THE DRAWING(S)

FIG. 1 is a sectional view taken along line A-A of FIG. 2 of a snap on drain back pour spout fitment according to the present invention;

FIG. 2 is a top plan view of the drain back pour spout fitment illustrated in FIG. 1;

FIG. 3 is an enlarged view of the pour spout of the fitment of FIGS. 1-2;

FIG. 7 is a sectional view of the closure for the drain back pour spout fitment illustrated in FIG. 1;

FIG. 8 is a bottom plan view of the closure of FIG. 7; and

FIG. 9 is an enlarged view of the tamper evident band of the closure of FIGS. 7-8 for engaging the elements in the fitment of FIG. 6.

DESCRIPTION OF THE PREFERRED EMBODIMENTS

Figure 4:
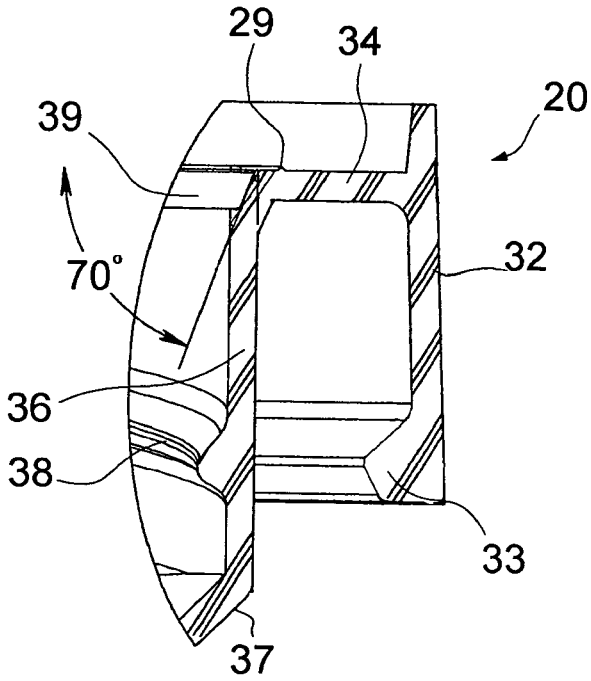
FIG. 4 is an enlarged sectional view of the attachment features of the fitment of FIGS. 1-2.
Figure 6:
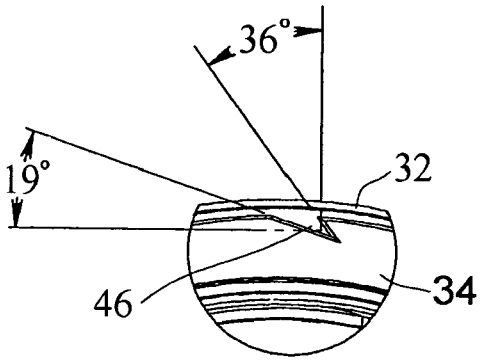
FIG. 6 is an enlarged plan view of the tamper evident elements of the fitment according to the present invention.
Figure 5:
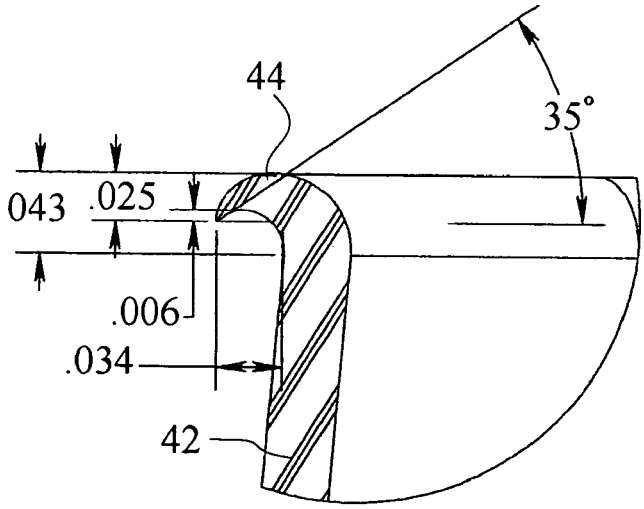
FIG. 5 is an enlarged sectional view of a drip-less pour tip of the pour spout according to the present invention.

A drain-back snap-on pour spout fitment closure 10 for containers or bottles (not shown) according to the present invention includes a drain back pour spout fitment 20 as shown in FIGS. 1-6 and a closure 30 as shown in FIGS. 7-9 attached thereto. The bottle or container structure is well known in the art as evidenced in the prior art discussed in detail above and incorporated herein by reference. The term "fitment closure" within the meaning of this application is that the fitment includes the closure thereon, as opposed to the alternative constructions of the prior art in which the closure is attached directly to the bottle or container.

The drain back pour spout fitment 20 is illustrated in detail in FIGS. 1-6. The fitment 20 is a one piece injection molded polypropylene component. The fitment includes a snap fit structure overlaying a container or bottle neck finish and which may be secured thereto with adhesives, or by welding. The snap fit structure, shown best in FIG. 4, has an outer annular skirt 32 with an internal, radial inwardly facing bead 33 generally for engaging beneath a radial outwardly facing surface of the bottle finish (not shown). A horizontal upper flange 34 extends inwardly from the outer annular skirt 32 below a top surface thereof, whereby an upper lip is formed by the skirt 32. The flange 34 may include a sealing bead 29 as shown in the figures. Optionally, a plurality of ribs may be spaced about the interior of the skirt 32 beneath the flange 34. The spout fitment 20 includes an inner annular skirt 36 (which may be formed with an offset 37 as shown in FIG. 1 and a transition surface 39 discussed below) with internal threads 38 on the fitment 20 to receive the externally threaded closure 30. The fitment 20 includes an angled apron 40 at a lower surface of the inner annular skirt 36 and extending to a central, tapered pour spout 42 with the pour spout 42 extending from the apron 40 to a position above the top surface of the outer annular skirt 32. The spout 42 has an open side aligned with an opening 41 in a lowermost portion of the apron 40 to form the drain back feature.

The pour spout 42 includes an outwardly extending drip-less pour tip 44 at an end thereof. The pour tip 44, shown in detail in FIG. 5, has a curved upper surface formed by two adjacent radii and extending beyond the upwardly extending side surfaces of the pour spout 42 for a distance greater than the width of the side surface of the pour spout. For example the side surface of the pour spout is about 0.035" thick and the pour tip 44 extends 0.034" beyond the side surface of the pour spout. The key feature of the pour tip 44 is providing a curved pour surface having a radius and length with a corresponding radius on the underside that in conjunction with the top radii is sufficient to minimize dripping during pouring, and this is known as drip-less pour spout technology and, by itself, is known in the art. The pour spout 42 in the fitment 20 of the invention results in a "jump feature" for molding. A jump feature is essentially a mold feature that must deform during de-molding operation. The outwardly extending pour tip 44 has been designed to accommodate such a molding operation (note the recessed underside of the pour tip 44. The pour tip 44 is opposite from the drain back opening 41 and the open side of the pour spout 42. Finally the fitment 20 includes several inwardly projecting ramp shaped projections 46, shown in FIG. 6 in detail, generally on an inner surface of the outer annular skirt 32 above the flange 34, with the projections 46 forming half of a tamper evident feature as will discussed below.

The closure 30 is illustrated in detail in FIGS. 6-9. The closure 30 is a one piece injection molded polypropylene component. The closure 30 is a closed end cap structure with a top 52 and annular side wall 54 extending down from the top 52. The closure 30 has a plug seal 56 and outer tamper evident band 58 connected to flange 59 above external threads 60. The plug seal 56 engages a surface 39 when in a closed position, wherein the surface 39 is 20 degrees from vertical and is adjacent the upper flange 34 of the fitment 20. The closure 30 will encompass the spout 42 and be threaded onto the fitment 20 to engage the seal 56 against the surface 39 and sealing bead 29 against flange 59. Further, tamper evident band 58 of the closure 30 has radial outwardly facing latches 62 extending from the band 58, with the latches 62 engaging the radial inwardly facing projections 46 on the fitment 20. Frangible leaders 64 connect the band 58 to the side wall 54 and plug seal 56. The tamper evident band 58 will be initially locked into place when the closure 30 is first threaded onto the fitment 20. Removal, by unthreading, of the closure 30 will fracture the leaders 64 disconnecting the tamper evident band 58 thereby forming or functioning as the safety feature for the fitment closure 10.

In operation the closure 30 is threaded onto the fitment 20 through the engagement of the threads 38 and 60 (until the latches 62 are in locking engagement with the projection 46 for the initial installation). With the plug seal 56 in sealing engagement with the surface 39 the fitment closure 10 is sealed, with the bead 29 and flange 59 forming a secondary seal. In removing the closure 30 from the fitment 20 the user simply unthreads the closure 30. This instruction (i.e. direction of rotation for on and off) can be molded onto the top 52 of the closure 30.

The above described embodiment is intended to be merely illustrative of the present invention and not restrictive thereof. The scope of the present invention is intended to be defined by the appended claims and equivalents thereof.

What is claimed is:

1. A fitment closure comprising:

A) a drain back pour spout fitment having i) a connecting structure overlaying a container neck finish, wherein the connecting structure has an outer annular skirt with at least one internal, radial inwardly facing connecting element, ii) a horizontal upper flange extending inwardly from the outer annular skirt, a sealing bead being coupled to the horizontal upper flange, iii) an inner annular skirt extending from the horizontal upper flange with internal threads on the inner annular skirt, a transition surface extending from the inner annular skirt to the horizontal upper flange, iv) a lower apron with a drain back opening in a lowermost portion thereof, and v) a pour spout extending from the apron, wherein the pour spout includes an outwardly extending drip-less pour tip and upwardly extending side surfaces; and B) a closure adapted to be joined to the fitment and removable from the fitment, the closure having i) a top having an annular side wall with a flange extending outwardly from the annular side wall, the flange extending outwardly from the annular side wall sealing against the sealing bead when the closure is attached to the fitment, ii) a plug seal engaging the transition surface when the closure is attached to the fitment, and iii) external threads that engage the internal threads of the inner annular skirt to secure the closure to the fitment.

2. The fitment closure of claim 1 wherein the drain back pour spout fitment is one piece injection molded polypropylene component, and wherein the drip-less pour tip has a curved lower surface extending from a distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

3. The fitment closure of claim 1 wherein the closure is a one piece injection molded polypropylene component, and wherein the drip-less pour tip has a curved lower surface extending from a distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

4. The fitment closure of claim 1 wherein the closure further includes a radial outwardly extending tamper evident band extending from the plug seal, and wherein the drip-less pour tip has a curved lower surface extending from a distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

5. The fitment closure of claim 4 wherein the plug seal has an outer beveled edge extending toward the outwardly extending flange and wherein the distal end of the drip-less pour tip is positioned vertically below the horizontal tangent to the upper curved surface of the drip-less pour tip by a distance that is at least 50% of the width of the upwardly extending side surfaces.

6. The fitment closure of claim 4 wherein the tamper evident band has a plurality of frangible leaders and wherein the distal end of the drip-less pour tip is positioned vertically below the horizontal tangent to the upper curved surface of the drip-less pour tip by a distance that is at least 50% of the width of the upwardly extending side surfaces.

7. The fitment closure of claim 1 wherein the pour tip extends around only a portion of the end of the pour spout and wherein a distal end of the drip-less pour tip is positioned vertically below the horizontal tangent to the upper curved surface of the drip-less pour tip by a distance that is at least 50% of the width of the upwardly extending side surfaces.

8. The fitment closure of claim 7 wherein the spout has an open side aligned with the opening in the apron and opposite from the pour tip, and wherein the drip-less pour tip has a curved lower surface extending from the distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

9. The fitment closure of claim 1 wherein the spout has an open side aligned with the opening in the apron, and wherein the drip-less pour tip has a curved lower surface extending from a distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

10. The fitment closure of claim 9 wherein the open side of the spout widens near the top of the spout and wherein the distal end of the drip-less pour tip is positioned vertically below the horizontal tangent to the upper curved surface of the drip-less pour tip by a distance that is at least 50% of the width of the upwardly extending side surfaces.

11. The fitment of claim 1 wherein the closure has a top and an annular side wall extending from the top, with the threads of the closure formed on the side wall and the side wall extends substantially beyond the threads, and wherein the drip-less pour tip has a curved lower surface extending from a distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

12. A drain back pour spout fitment having i) a snap fit structure overlaying a container or bottle neck finish, wherein the snap fit structure has an outer annular skirt with at least one internal, radial inwardly facing bead, ii) a horizontal upper flange extending inwardly from the outer annular skirt, an upwardly extending sealing bead on the horizontal upper flange, iii) an inner annular skirt extending from the flange with internal threads on the inner annular skirt, a transition surface extending from the inner annular skirt to the horizontal upper flange, the transition surface being configured for sealing engagement, iv) a lower apron with a drain back opening in a lowermost portion thereof, and v) a pour spout extending from the apron, the pour spout having a drip-less pour tip and upwardly extending side surfaces.

13. The fitment of claim 12 wherein the fitment is a one piece injection molded polypropylene component, and wherein the drip-less pour tip has a curved lower surface extending from the distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

14. The fitment of claim 13 wherein the pour tip extends around only a portion of the end of the pour spout and wherein the distal end of the drip-less pour tip is positioned vertically below the horizontal tangent to the upper curved surface of the drip-less pour tip by a distance that is at least 50% of the width of the upwardly extending side surfaces.

15. The fitment of claim 14 wherein the spout has an open side aligned with the opening in the apron and opposite from the pour tip.

16. The fitment of claim 12 wherein the spout has an open side aligned with the opening in the apron, and wherein the drip-less pour tip has a curved lower surface extending from the distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

17. The fitment of claim 12 wherein the open side of the spout widens near the top of the spout, and wherein the drip-less pour tip has a curved lower surface extending from the distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

18. A fitment closure comprising: a drain back pour spout fitment having i) a connecting structure overlaying a container neck finish, wherein the connecting structure has an outer annular skirt with at least one internal, radial inwardly facing connecting element, ii) a horizontal upper flange extending inwardly from the outer annular skirt, a sealing bead being coupled to the horizontal upper flange, iii) an inner annular skirt extending from the flange with internal threads on the inner annular skirt, and radial inwardly facing interfering tamper evident band engaging projections, a transition surface extending from the inner annular skirt to the horizontal upper flange, iv) a lower apron with a drain back opening in a lowermost portion thereof, and v) a pour spout extending from the apron, wherein the pour spout includes an outwardly extending drip-less pour tip having a curved upper surface extending beyond the upwardly extending side surfaces of the pour spout to a distal end of the drip-less pour tip wherein the distal end of the drip-less pour tip is positioned vertically below a horizontal tangent to the curved upper surface of the drip-less pour tip; and a closure removable from to the fitment, the closure having i) a plug seal engaging the transition surface when the closure is attached to the fitment, ii) a top having an annular side wall with a flange extending outwardly from the annular side wall, the flange sealing against the sealing bead when the closure is attached to the fitment, iii) a radial outwardly facing tamper evident band engaging the radial inwardly facing interfering projections on the fitment forming a tamper evidence safety feature for the closure, and iv) external threads that engage the internal threads of the inner annular skirt to secure the closure to the fitment.

19. The fitment closure of claim 18 wherein the connecting structure is a snap on connection and the connecting element is a bead, and wherein the drip-less pour tip has a curved lower surface extending from the distal end of the drip-less pour tip to the upwardly extending side surfaces of the pour spout, wherein at least a portion of the curved lower surface of the drip-less pour tip is positioned vertically above a horizontal plane running through the distal end of the drip-less pour tip.

20. The fitment closure of claim 18 wherein the drain back pour spout fitment and the closure are each one piece injection molded polypropylene components and wherein the distal end of the drip-less pour tip is positioned vertically below the horizontal tangent to the upper curved surface of the drip-less pour tip by a distance that is at least 50% of the width of the upwardly extending side surfaces.

* * * * *